US006422383B1

(12) United States Patent
LaMarca

(10) Patent No.: US 6,422,383 B1
(45) Date of Patent: Jul. 23, 2002

(54) JEWELRY STORAGE AND DISPLAY CLOSET

(76) Inventor: Edward R. LaMarca, 6339 Crosby Rd., Lockport, NY (US) 14094

( * ) Notice: Subject to any disclaimer, the term of this patent is extended or adjusted under 35 U.S.C. 154(b) by 3 days.

(21) Appl. No.: 09/686,407

(22) Filed: Oct. 11, 2000

Related U.S. Application Data

(60) Provisional application No. 60/160,238, filed on Oct. 18, 1999.

(51) Int. Cl.[7] ..... A45C 11/04

(52) U.S. Cl. ..... 206/6.1; 206/775; 206/806; 220/751; 220/768

(58) Field of Search ..... 206/6.1, 566, 775, 206/806, 768, 771; 220/751, 752

(56) References Cited

U.S. PATENT DOCUMENTS

| | | | | | |
|---|---|---|---|---|---|
| 1,541,354 | A | | 6/1925 | Harrison | |
| 2,048,695 | A | | 7/1936 | Hasenour | |
| 2,470,993 | A | * | 5/1949 | Kramer | 206/6.1 |
| 4,396,121 | A | * | 8/1983 | Lemmon | 206/566 |
| 5,117,971 | A | * | 6/1992 | Fisher | 206/6.1 |
| 5,409,105 | A | * | 4/1995 | Appelbaum et al. | 206/6.1 |
| 5,603,558 | A | * | 2/1997 | Zimmer | 206/566 |
| 5,890,589 | A | | 4/1999 | Lorens | |
| 6,161,686 | A | * | 12/2000 | Simon et al. | 206/6.1 |

* cited by examiner

*Primary Examiner*—Bryon P. Gehman
(74) *Attorney, Agent, or Firm*—Hodgson Russ LLP

(57) ABSTRACT

This invention relates to a jewelry storage and display device, having a vertically mounted slideable drawer disposed within a housing. The housing contains a light transmitting face panel for viewing the stored jewelry. Attached to the drawer are various brackets for storage of a variety of jewelry including hoop and clip earrings, chains or post earrings, cufflinks or pins.

3 Claims, 6 Drawing Sheets

JEWELRY STORAGE AND DISPLAY CLOSET

CLAIM OF PRIORITY

This application claims priority to U.S. provisional patent application No. 60/160,238 filed Oct. 18, 1999.

FIELD OF THE INVENTION

The invention relates to organizing and storage devices, having the ability to store and display its contents either in an open display or closed storage.

DESCRIPTION OF PRIOR ART

The use of compartmentalized storage for various materials is known in the art. In general, examples of prior art may include plastic or clear acrylic organizers for storage of jewelry, hardware, and other items; these items are commercially available in the marketplace to businesses and consumers alike. Other related products includes compartmental organizers for the storage of condiments, candies and related items.

Specifically, in U.S. Pat. No. 5,890,589, Loren discloses a display block box for various goods, including photographs, graphic materials, as well as jewelry. Embodiments of this design are depicted as designs to be used on a flat, horizontal surface.

Harrison, in U.S. Pat. No. 1,541,354, discloses a box and sign holder for display, including a mechanism for removing an entire wall of display box to insert a display card.

The art also discloses U.S. Pat. No. 2,048,695, which reveals a medicine glass rack holding an individual printed card. The medicines are stored in individual containers in the apparatus.

Today, many people do not store their jewelry and other small items of value, they are simply thrown into a drawer. In this manner, these items have a tendency to be misplaced or lost, as well as being scratched or chipped. Another way of storing jewelry is to place it in a jewelry box or armoire drawer. Both of these methods can be extremely time consuming and expensive, and may not solve the problem of misplaced or lost jewelry.

SUMMARY OF THE INVENTION

This invention relates to a jewelry storage and display device, having a vertically mounted slideable drawer disposed within a housing. The housing contains a light transmitting face panel for viewing the stored jewelry. Attached to the drawer are various brackets for storage of a variety of jewelry including hoop and clip earrings, chains or post earrings, cufflinks or pins.

The foregoing and additional advantages and characterizing features of the present invention will become clearly apparent upon reading of the ensuing description together with the included drawings wherein:

BEST MODE FOR CARRYING OUT THE INVENTION

The details of the present invention, will. be described in connection with an embodiment of the jewelry storage and display closet.

Figure 1:
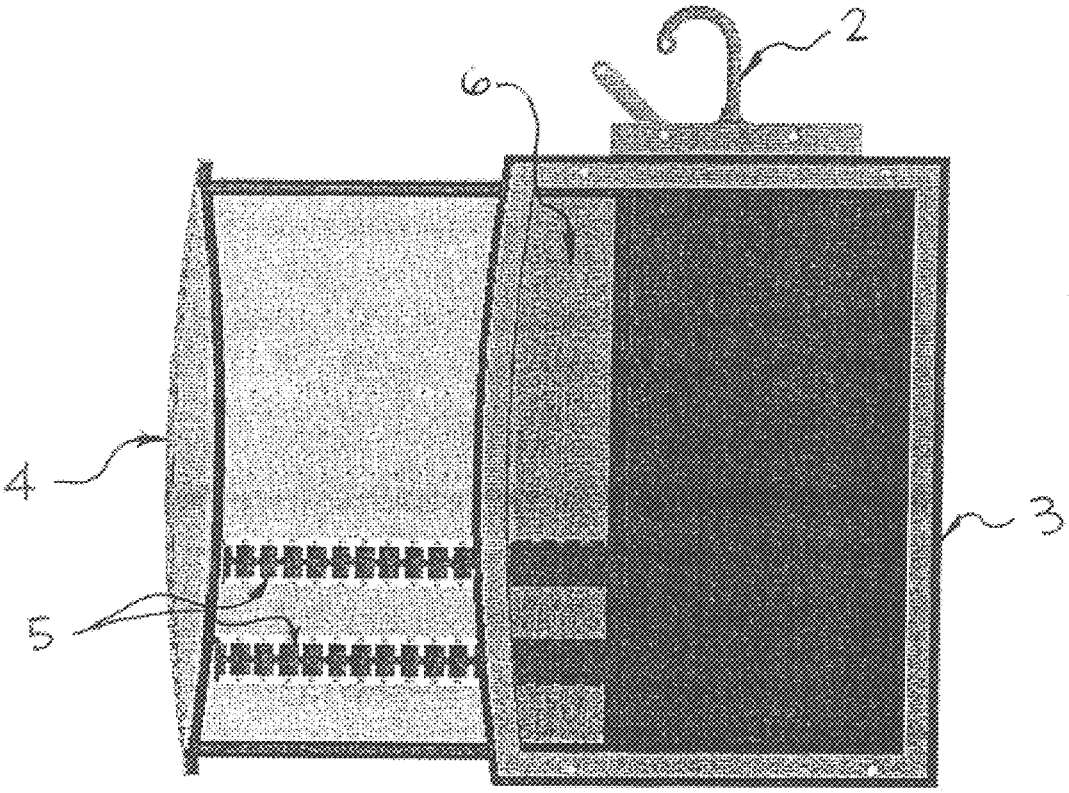
FIG. 1 depicts a front elevational view of an embodiment of the jewelry storage and display case.

FIG. 1 depicts a front view of an embodiment of the storage closet having a housing 3, hanging device 2, vertical panel drawer 4, storage racks 5, and light-penetrating material face 6.

Figure 2:
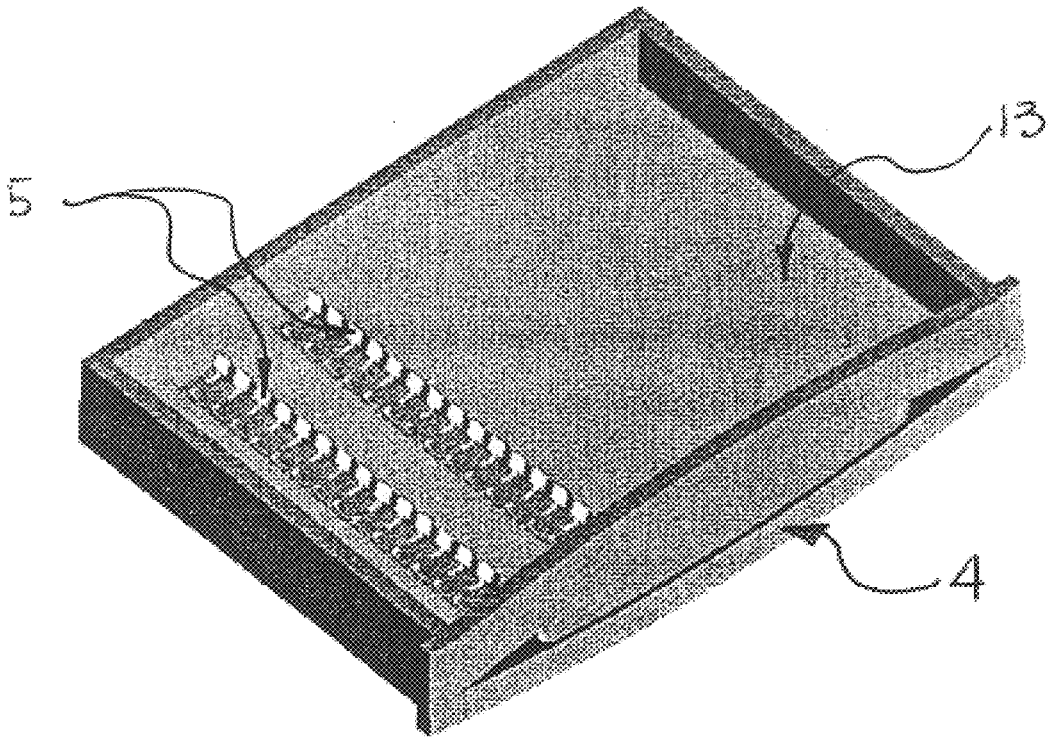
FIG. 2 shows a perspective view of an embodiment the storage drawer.

FIG. 2 shows a prospective view of an embodiment of a drawer 4, having a rear panel 7, with storage brackets 5.

Figure 3:
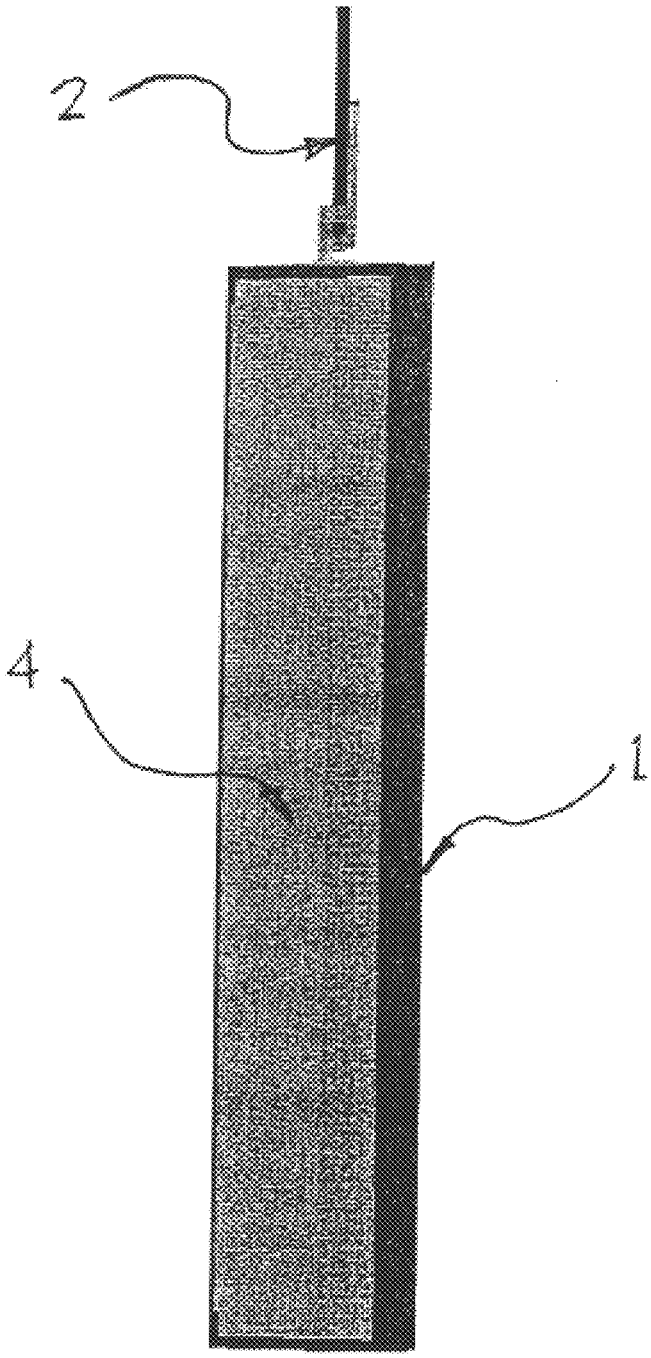
FIG. 3 shows a side elevation of an embodiment of the device.

FIG. 3 shows a side elevation of one embodiment of the storage closet 1, having hanging device 2, with vertically mounted, moveable drawer 4.

Figure 4:
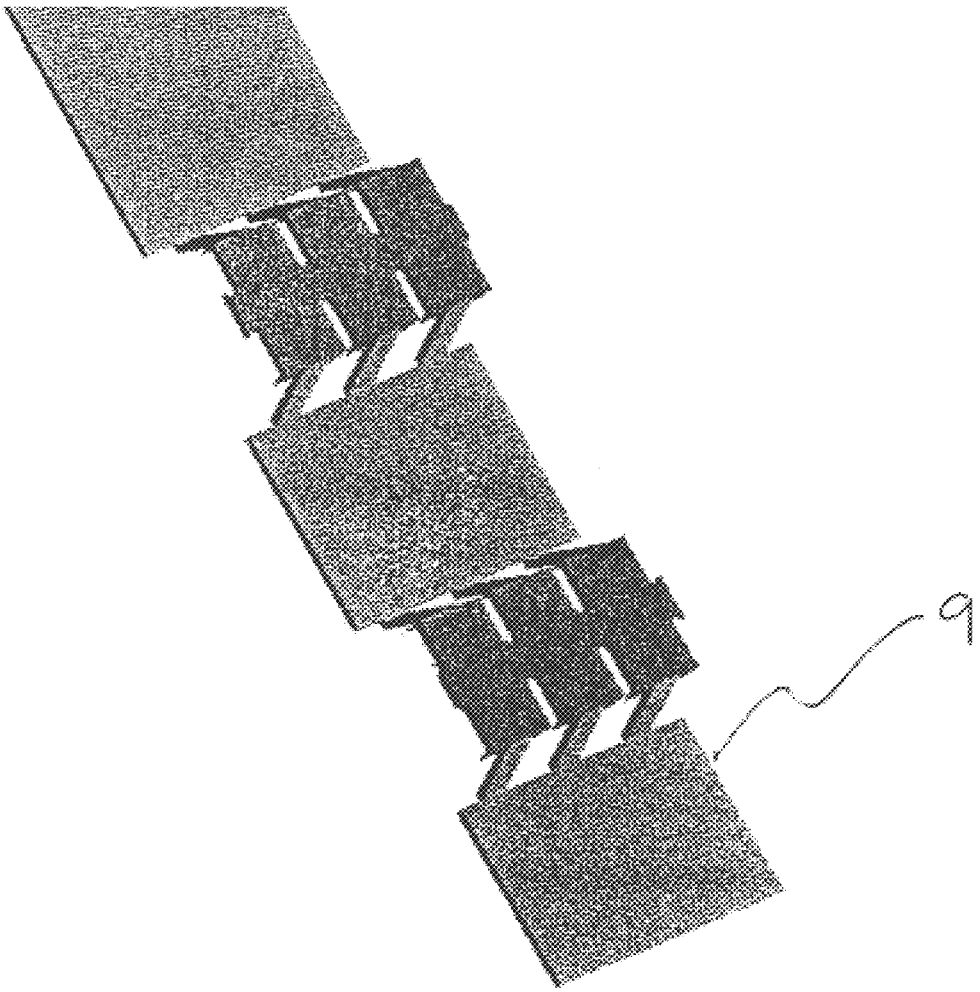
FIG. 4 shows a detailed view of an embodiment of a bracket for hoop and clip earrings.

FIG. 4 shows a detailed view of bracket embodiment 5, for hoop and clip earrings.

Figure 5:
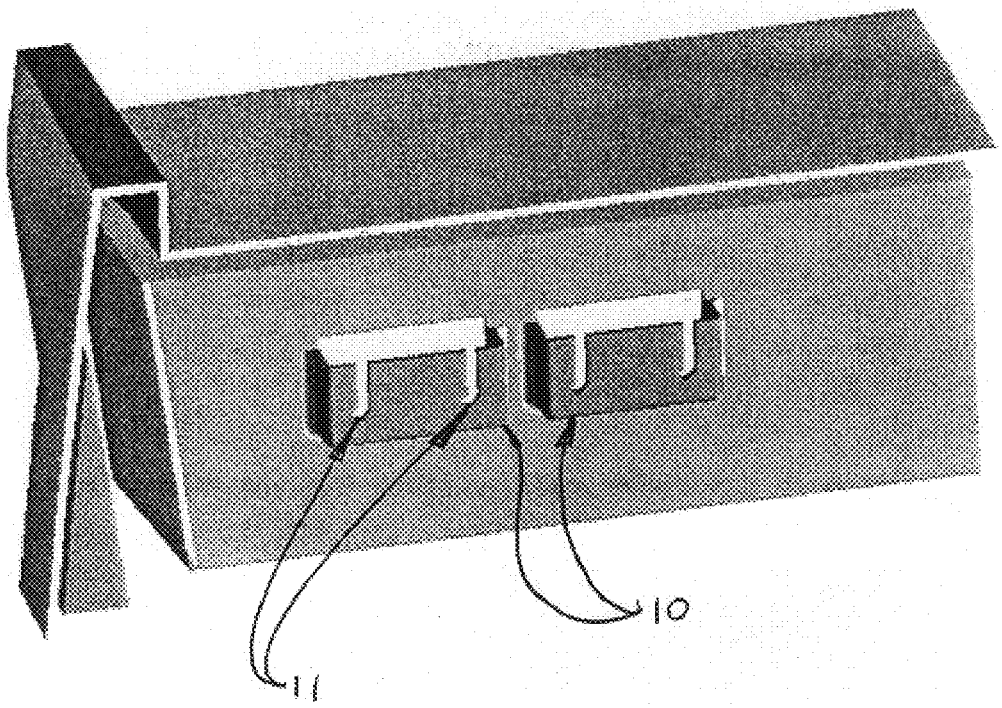
FIG. 5 shows an embodiment of a bracket for chains or post earrings.

FIG. 5 shows a bracket embodiment 10, with notched slot 11, for chains or post earrings.

Figure 6:
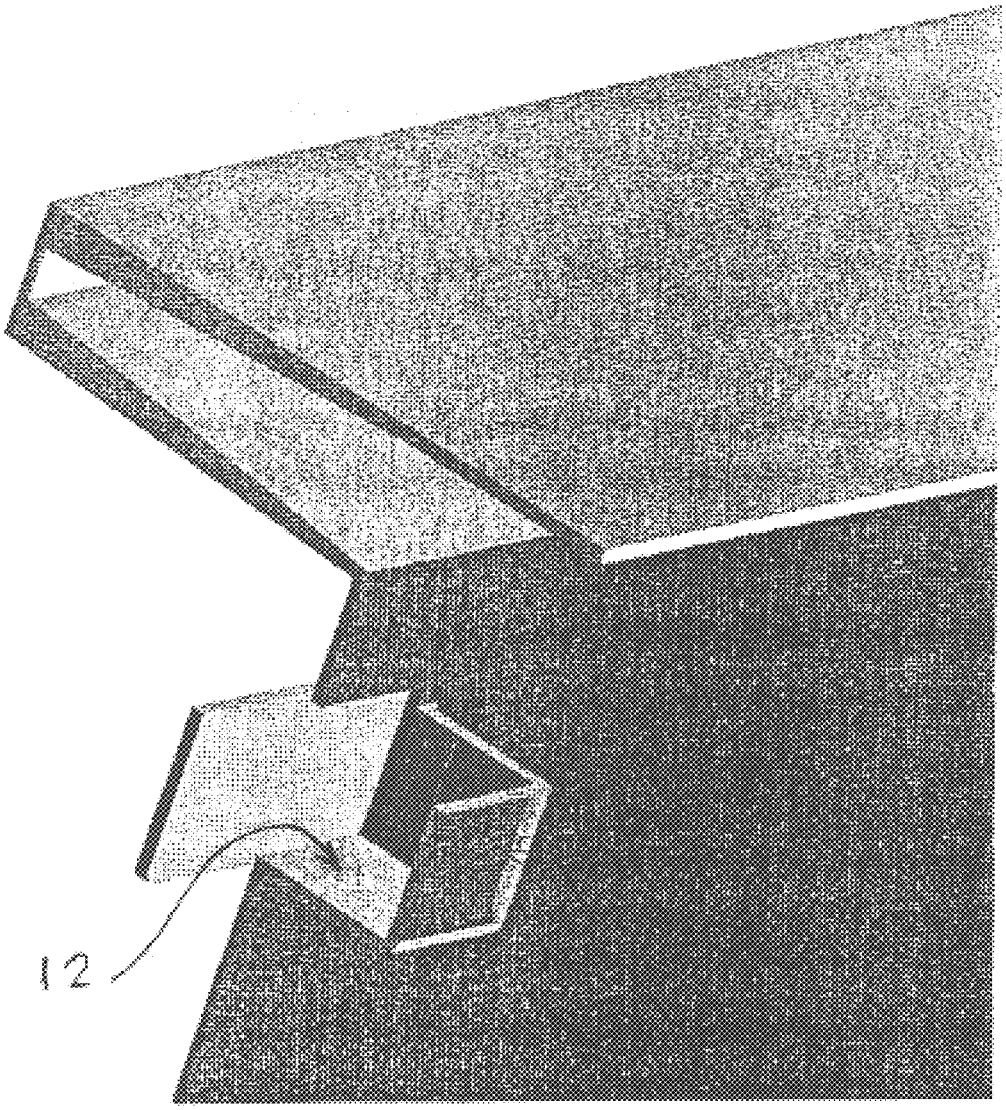
FIG. 6 shows an embodiment of a bracket for cufflinks or other decorative jewelry.

FIG. 6 shows a holding device embodiment 12, for cufflinks or other decorative jewelry.

The device can be manufactured in a number of different shapes. It can be rectangular or other geometrical arrangement which provides good visual display as well as ease of access to the various stored items. The device can be constructed of wood, plastic, glass, fibrous material, metal or composite material. it can be free standing, mounted on a wall or hanging from a hook or other hanging device.

The preferred embodiment is a rectangular shaped housing made having a wood frame with transparent face, having a vertically mounted display drawer which slides horizontally from the housing, making the displayed jewelry readily available for the user.

The drawer may contain various combination of storage brackets for earrings, chains, cuff links and the like. It is an object to this invention to create device to organize and store various types of jewelry, including earrings, rings, chains, and the like.

Furthermore, it is an object to this invention to create a device to visually display the contents while stored.

The storage device is cheaper than an armoire and can be made of a durable material, such as plastic, acrylic, or other light-penetrating materials in conjunction with a structural frame composed of a number of materials, including metal, wood, plastic composites, or combinations thereof.

The device may contain single or multiple sliding panels for storing, arranging, holding and visual display of jewelry or other items.

While preferred embodiments of the present invention have been disclosed, it will be appreciated that it is not limited-thereto but may be otherwise embodied with the scope of the following claims.

I claim:

1. A jewelry storage and display device comprising:

a) a housing with a light transmitting face panel, a top panel having a hanging mechanism extending therefrom in order for the housing to be hung, an opposing face panel, a bottom panel, and a rear panel connected to the bottom panel, the top panel, the light transmitting face panel, and the opposing face panel to form a cavity and an opening in the housing;

b) a slideable drawer having an exposed panel with a ndle thereon so the drawer can be pulled from the housing, a second top panel, a second rear panel, and a second bottom to form an outer perimeter of the slideable drawer so that when the slideable drawer is within the housing the second top panel and the top panel, the second rear panel and the rear panel, and the second bottom panel and the bottom panel are adjacent to each other, and within the outer perimeter is a display panel having protrusions and apertures to allow jewelry and other small items to be removably affixed to the display panel, wherein when the slideable drawer is within the housing the jewelry and other small items can be seen through the light transmitting panel, and wherein when the housing is hung a portion of the display panel can be removed, but not completely removed, from the housing so the jewelry is exposed and removable from the display panel while the housing remains hanging.

2. A device as in claim 1, containing at least one bracket selected from the group consisting of: hoop or clip earrings, chains, post earrings, cufflinks and pin holding devices.

3. A device as in claim 1, wherein the housing is made from at least one of the group consisting of plastic, glass, wood, fibrous material, metal and composite materials.

* * * * *